US009387377B2

(12) United States Patent
Liang et al.

(10) Patent No.: US 9,387,377 B2
(45) **Date of Patent: *Jul. 12, 2016**

(54) GOLF CLUB HEAD WITH ADJUSTABLE CENTER OF GRAVITY

(71) Applicant: CALLAWAY GOLF COMPANY, Carlsbad, CA (US)

(72) Inventors: Ten Ken Liang, Tainan (TW); Matthew Myers, Carlsbad, CA (US); Sean P. Griffin, Encinatas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/789,655

(22) Filed: Jul. 1, 2015

(65) Prior Publication Data

US 2015/0314176 A1 Nov. 5, 2015

Related U.S. Application Data

(60) Division of application No. 13/923,571, filed on Jun. 21, 2013, now Pat. No. 9,084,921, which is a continuation-in-part of application No. 13/778,958, filed on Feb. 27, 2013, now Pat. No. 8,894,506.

(60) Provisional application No. 61/727,608, filed on Nov. 16, 2012.

(51) Int. Cl.
*A63B 53/04* (2015.01)
*A63B 53/06* (2015.01)

(52) U.S. Cl.
CPC ..... *A63B 53/06* (2013.01); *A63B 53/0466* (2013.01); *A63B 60/52* (2015.10); *A63B 2053/0433* (2013.01); *A63B 2053/0491* (2013.01); *A63B 2209/00* (2013.01)

(58) Field of Classification Search
CPC ..... A63B 53/06
See application file for complete search history.

(56) References Cited

U.S. PATENT DOCUMENTS 7,611,424 B2 * 11/2009 Nagai ..... A63B 53/0466 473/334
2006/0122004 A1 * 6/2006 Chen ..... A63B 53/0466 473/335

* cited by examiner

*Primary Examiner* — Michael Dennis
(74) *Attorney, Agent, or Firm* — Rebecca Hanovice; Michael Catania; Sonia Lari

(57) ABSTRACT

A golf club head comprising a channel and an expandable weight that can be removably fixed at any point within the channel is disclosed herein. The weight comprises at least an upper portion, a middle portion, a lower portion, and a bolt, and the upper portion and lower portion preferably are formed of metal materials while the middle portion preferably is formed of a polymeric material. The weight preferably is trapped within the channel so that it cannot fall out of the channel during use. The channel may also have an end that opens into a port, which can be filled with a plug or weight screw to prevent the weight from falling out of the channel, and also can be removed so that the weight can be removed and replaced with another expandable weight having a different overall mass.

18 Claims, 11 Drawing Sheets

GOLF CLUB HEAD WITH ADJUSTABLE CENTER OF GRAVITY

CROSS REFERENCES TO RELATED APPLICATIONS

The present application is a division of U.S. patent application Ser. No. 13/923,571, filed on Jun. 21, 2013, and issued on Jul. 21, 2015, as U.S. Pat. No. 9,084,921, which is a continuation-in-part of U.S. patent application Ser. No. 13/778,958, filed on Feb. 27, 2013, and issued on Nov. 25, 2014, as U.S. Pat. No. 8,894,506, which claims priority to U.S. Provisional Patent Application No. 61/727,608, filed on Nov. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a weight for a golf club head that can be adjusted along a continuous channel.

2. Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention is a novel way of working with adjustable products. The present invention allows consumers to easily move and fix a weight at any location within a channel in their golf club head. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

Another aspect of the present invention is a golf club head comprising a body comprising a channel and a port, an expandable weight, and a plug sized to fit within the port, wherein the expandable weight is disposed within and movable to any point within the channel, and wherein expanding the weight reversibly fixes it in place within the channel. In some embodiments, the expandable weight may comprise an upper portion, a lower portion, and a bolt, and in some further embodiments at least one of the upper portion and the lower portion may be composed of a material, such as stainless steel or tungsten alloy, that is co-molded with a polymeric material, such as a rubber material. In some embodiments, the upper portion may comprise a depression and a threaded bore sized to receive the bolt, and the lower portion may comprise a cavity and a projection sized to fit within the depression. In alternative embodiments, the upper portion may comprise a projection and a threaded bore sized to receive the bolt, and the lower portion may comprise a cavity and a depression sized to receive the projection.

Yet another aspect of the present invention is a driver-type golf club head comprising a composite crown, a titanium body comprising a face, a sole, a channel, and a weight port, a weight screw sized to fit within the weight port, and an expandable weight comprising an upper portion, a lower portion, a bolt, and a first width, wherein at least one of the upper portion and the lower portion comprises a metal material that is co-molded with a polymeric material, wherein the channel comprises an opening having a second width and an innermost surface having a third width, wherein the second width is less than both the first width and the third width, wherein the expandable weight is contained within and movable to any point within the channel, and wherein expanding the weight reversibly fixes it in place within the channel. In some further embodiments, the channel may comprise an open first end and a closed second end, the weight port may be disposed at the first end, and inserting the weight screw into the weight port may close the first end of the channel and prevent the expandable weight from leaving the channel. In other embodiments, the polymeric material may be a rubber material. In still other embodiments, at least one side of the channel may be provided by the composite crown.

Another aspect of the present invention is a golf club head comprising a body comprising a sole and a channel, an expandable weight disposed, and movable to any point, within the channel, and a cover fixture, wherein affixing the cover fixture to the sole traps the expandable weight within the channel, and wherein expanding the weight reversibly fixes it in place within the channel. In some embodiments, the expandable weight may comprise an upper portion, a lower portion, a bolt, and a first width, and at least one of the upper portion and the lower portion may be composed of stainless steel co-molded with a polymeric material.

Another aspect of the present invention is a golf club head comprising a body comprising a channel, an expandable weight comprising a first piece, a second piece, and a third piece, and a bolt, wherein the expandable weight is disposed within and movable to any point within the channel, and wherein expanding the weight reversibly fixes it in place within the channel. The first piece may composed of a first metal material, such as 17-4 stainless steel, the second piece may composed of a polymeric material, such as plastic or rubber, and the third piece may composed of a second metal material that is different from the first metal material, such as a tungsten or titanium alloy. In some embodiments, the body may comprise a face, a sole, a crown, a heel end, a toe end, and a rear end, and the channel may be disposed within the sole proximate the rear end. In some further embodiments, the channel may extend from the toe end to the heel end. In other embodiments, the channel may extend from the face to the rear end.

In other embodiments, each of the channel and the expandable weight may have an approximately hourglass cross-sectional shape. The channel may comprise an open first end and a closed second end, a weight port may be disposed at the first end, and inserting a weight screw into the weight port may close the first end of the channel. In some embodiments, the first piece may comprise a first through bore, an upper recess, a lower recess having two open sides, and a ledge, the bolt may comprise a head and a threaded portion, the threaded portion may extend through the through bore, and the head may be disposed within the upper recess and rests against the ledge. In other embodiments, the second piece may comprise a second through bore sized to receive the threaded portion, and the second piece may be disposed within the lower recess. In a further embodiment, the third piece may comprise a third through bore sized to receive the threaded portion, the third piece may be disposed below the second piece so that the second piece is sandwiched between the first piece and the third piece, and the third through bore may comprise threads sized to mate with the threads of the threaded portion. In another embodiment, the golf club head may be selected from the group consisting of a driver head, a fairway wood head, and a hybrid head.

Yet another aspect of the present invention is a driver-type golf club head comprising a crown, a titanium body comprising a face, a sole, a channel, and a weight port, a weight screw sized to fit within the weight port, and an expandable weight comprising an upper portion composed of a metal material, a middle portion composed of a polymeric material, a lower portion composed of a metal material, and a bolt, wherein each of the channel and the weight port is disposed in the sole, wherein the channel comprises an open first end and a closed second end, wherein the weight port is disposed at the first end, wherein inserting the weight screw into the weight port closes the first end of the channel and prevents the expandable weight from leaving the channel, wherein the expandable weight is contained within and movable to any point within the channel, and wherein expanding the weight reversibly fixes it in place within the channel. In some embodiments, the upper portion may be composed of 17-4 stainless steel, the middle portion may be composed of plastic or rubber, and the lower portion may be composed of a tungsten alloy. In some embodiments, the crown may be composed of a composite material.

Another aspect of the present invention is a golf club head comprising a body comprising a sole and a channel, an expandable weight disposed, and movable to any point, within the channel, and a cover fixture, wherein affixing the cover fixture to the sole traps the expandable weight within the channel, wherein the expandable weight comprises an upper portion composed of a metal material, a middle portion composed of a polymeric material, a lower portion composed of a metal material, and a bolt, and wherein expanding the weight reversibly fixes it in place within the channel. In some embodiments, each of the channel and the expandable weight may have an approximately hourglass cross-sectional shape. In some embodiments, the cover fixture may be a crown, which may be composed of a material selected from the group consisting of composite, plastic, titanium alloy, and stainless steel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
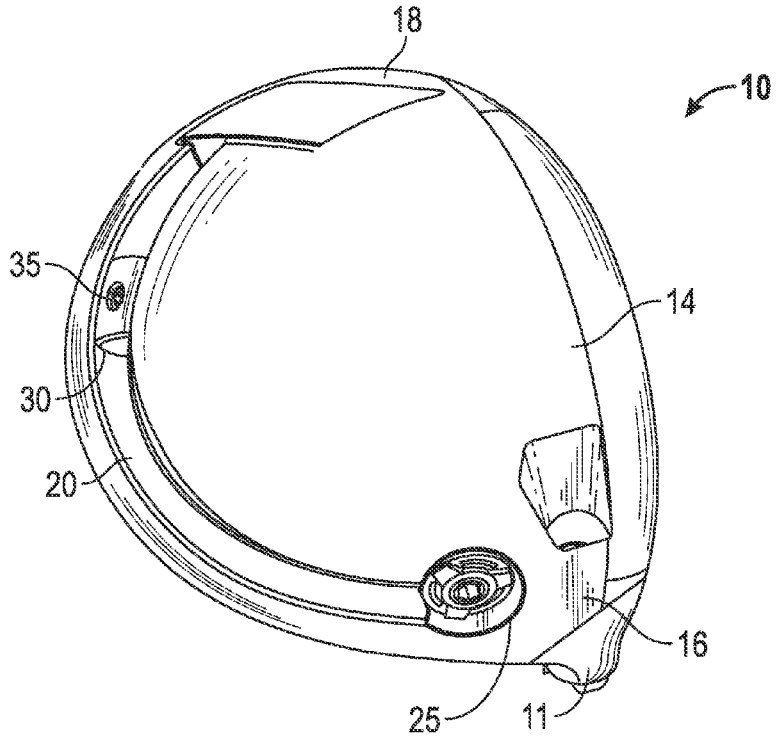
FIG. 1 is a bottom perspective view of a golf club head encompassing a first embodiment of the present invention.
Figure 2:
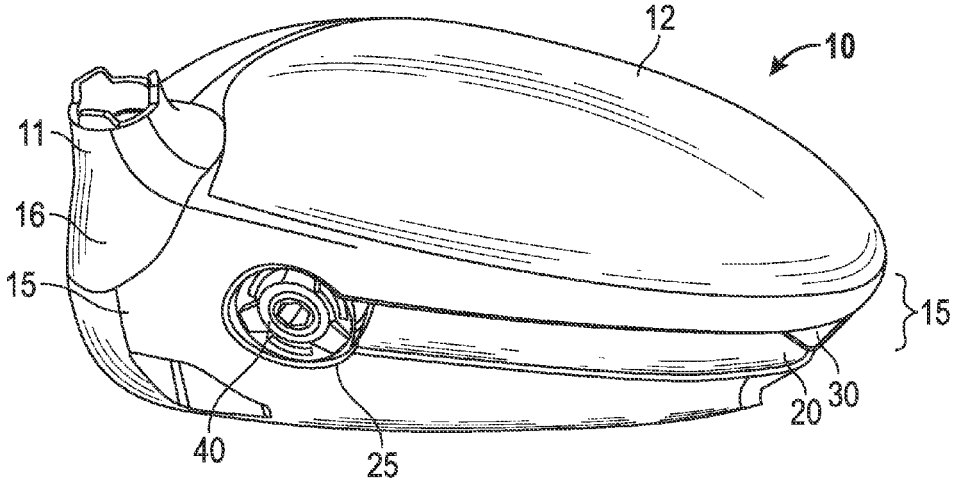
FIG. 2 is a first side perspective view of the embodiment shown in FIG. 1.
Figure 3:
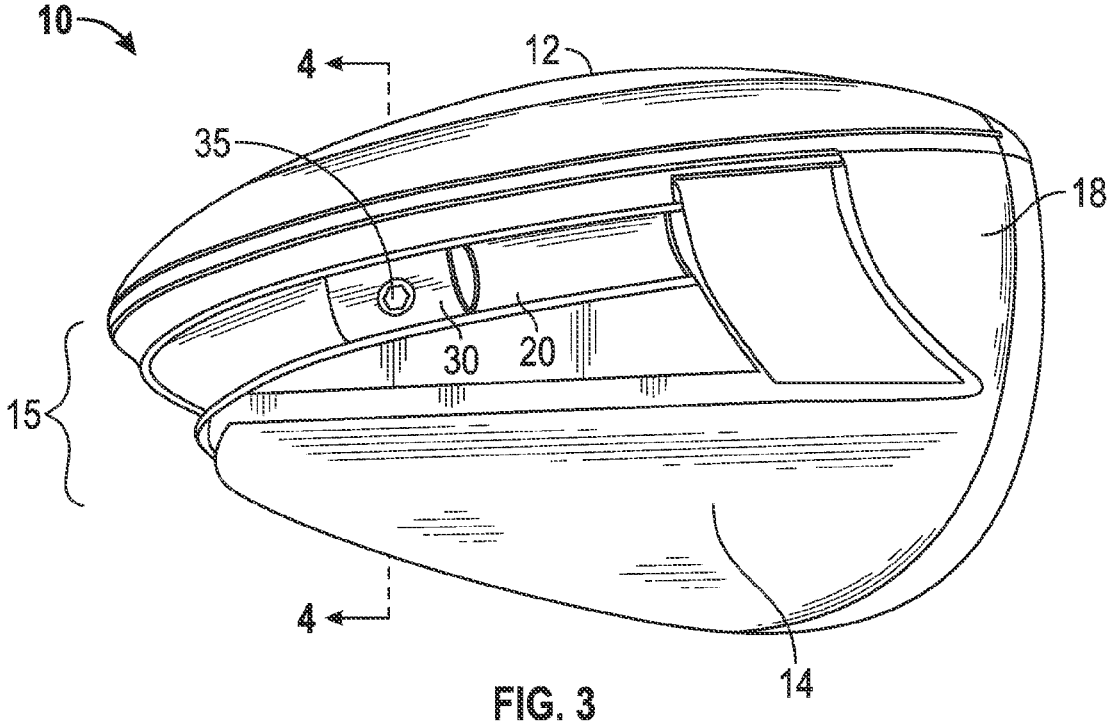
FIG. 3 is a second side perspective view of the embodiment shown in FIG. 1.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. It can also work in conjunction with at least one adjustable weight port on the sole of the driver head. Shifting weight along the channel described herein allows for control of center of gravity location.

A first embodiment of the present invention is shown in FIGS. 1-4. The golf club head 10 comprises a channel 20 disposed within a side or ribbon 15 portion of the golf club head 10, but may in alternative embodiments may be disposed in the crown 12 and/or sole 14. The channel 20 extends from a heel side 16 of the club head proximate a hosel 11 to a toe side 18 of the golf club head 10, and has a curved cross-sectional shape with an internal width W1 that is greater than an external opening width W2. The channel 20 may have any of the configurations disclosed in U.S. patent application Ser. No. 13/656,271, the disclosure of which is hereby incorporated by reference in its entirety herein.

Figure 4:
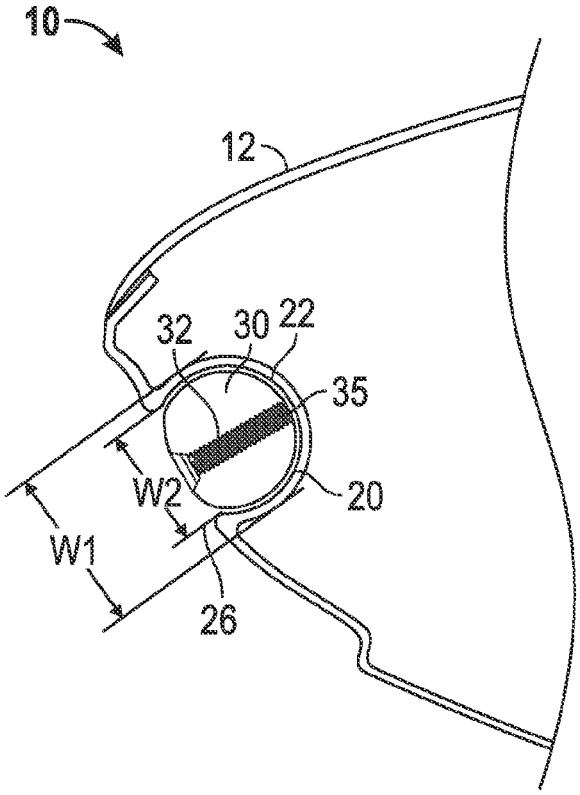
FIG. 4 is a cross-sectional view of the embodiment shown in FIG. 3 along lines 4-4.
Figure 5:
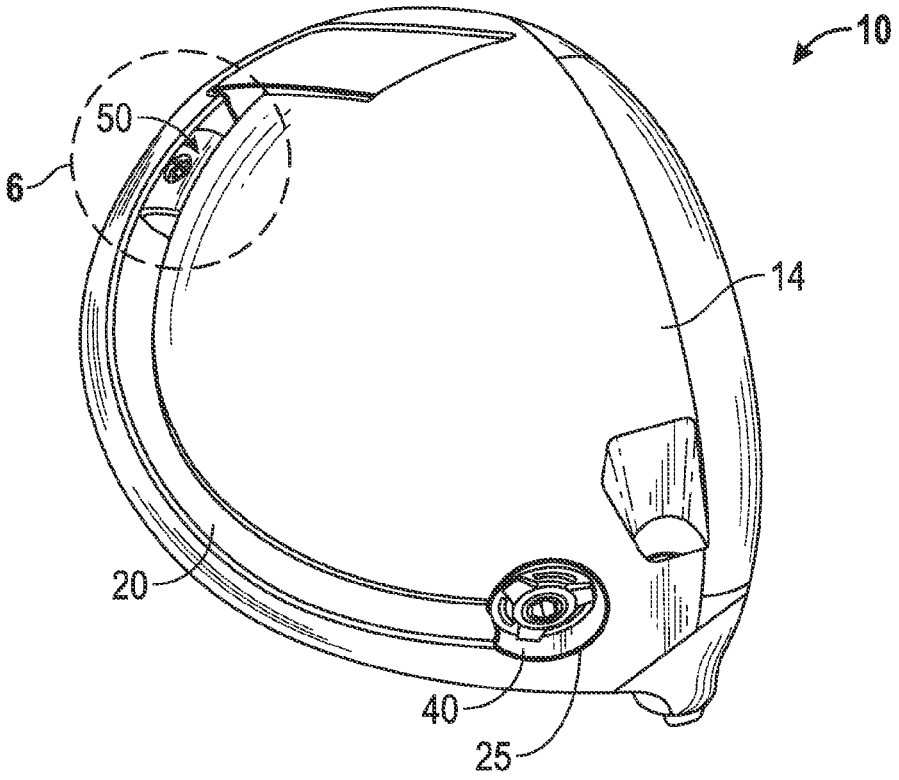
FIG. 5 is a bottom perspective view of a golf club head encompassing a second embodiment of the present invention.

A slidable weight 30 is disposed within the channel 20, and is inserted into the channel 20 at an opening 25 proximate the heel 16, which is closed with a weight screw 40 or a lightweight plug once the slidable weight 30 is inserted into the channel 20. The weight screw 40 or plug and slidable weight 30 can be made of any material known to a person of ordinary skill in the art, and can be selected to better adjust mass properties of the club head. Once the opening 25 is closed, the slidable weight 30 is trapped within the channel 20, though removing the weight screw 40 or the plug allows the slidable weight 30 to be removed and exchanged for one having different structural and/or material characteristics. As shown in FIGS. 1-4, the slidable weight 30 has a greater width than the width W2 of the opening 26 of the channel 20, preventing it from falling out of the channel 20 during use, but has dimensions that allow it to easily slide along the length of the channel 20. In this embodiment, the slidable weight 30 is fixed within the channel at a desired location with a screw 35 that extends through a bore 32 in the slidable weight 30 to engage a floor portion 22 of the channel 20 as shown in FIG. 4 and press the slidable weight 30 against the edges of the opening 26 of the channel 20. In alternative embodiments, the slidable weight 30 is fixed within the channel at a desired location by any means known to a person of ordinary skill in the art, including with a semi-permanent adhesive or one or more of the mechanisms disclosed in U.S. Pat. No. 7,147,573 to DiMarco and U.S. Pat. No. 7,166,041 to Evans, the disclosure of each of which is hereby incorporated by reference in its entirety herein.

Figure 6:
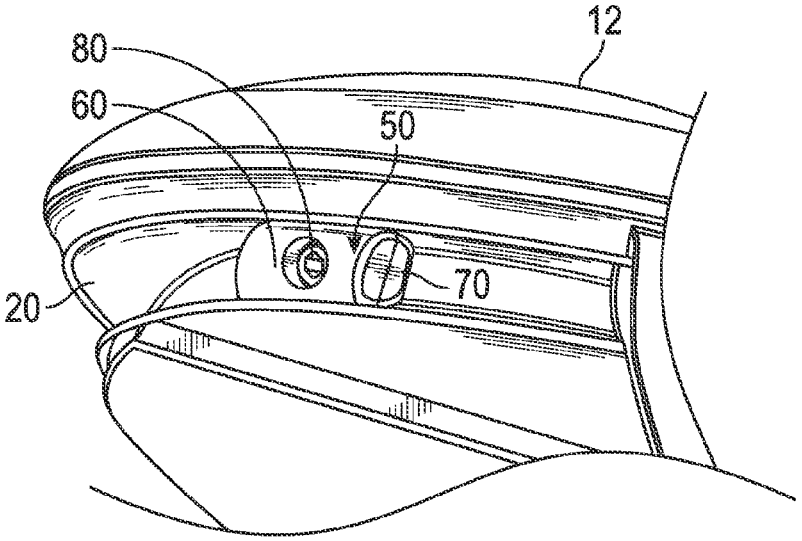
FIG. 6 is an enlarged view of the circled portion in FIG. 5, with the weight in a movable configuration.
Figure 7:
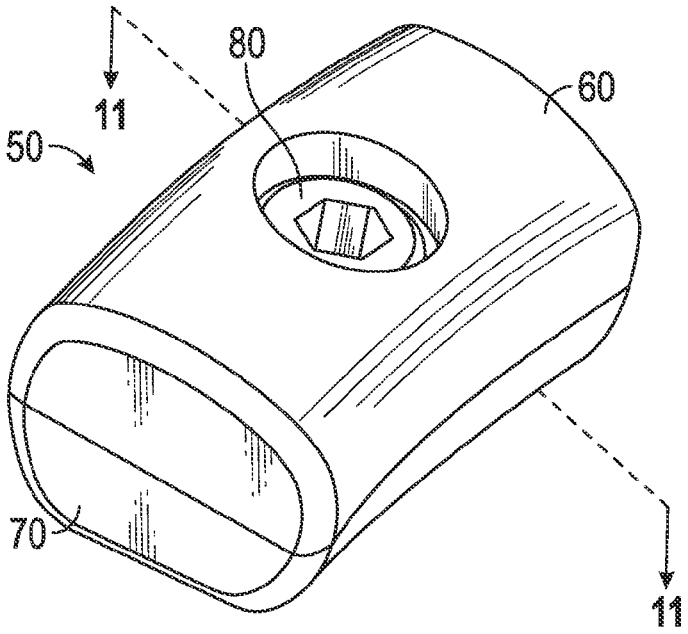
FIG. 7 is a side perspective view of the weight shown in FIG. 6.
Figure 8:
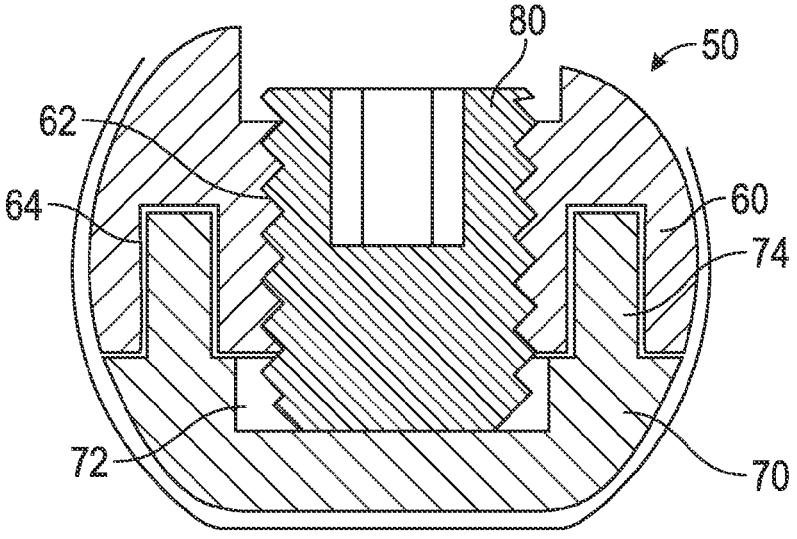
FIG. 8 is a cross-sectional view of the weight shown in FIG. 7 along lines 8-8.

A second embodiment of the present invention is shown in FIGS. 5-11. In this embodiment, the golf club head 10 includes the channel 20, opening 25, and weight screw 40 of the first embodiment, but the slidable weight 50 of this embodiment is semi-permanently fixed within the channel 20 via an expandable, multi-piece construction. As shown in FIGS. 6-11, the slidable weight 50 comprises an upper portion 60 having a threaded bore 62 and a depression 64, a lower portion 70 having a cavity 72 and a projection 74, and a bolt 80, though in an alternative embodiment the upper portion 60 may have a projection and the lower portion 70 may have a depression. As shown in FIG. 8, the projection 74 of the lower portion 70 fits within the depression 64 of the upper portion 60 and prevents the slidable weight 50 from falling apart as it is moved within the channel 20 of the present invention.

Figure 9:
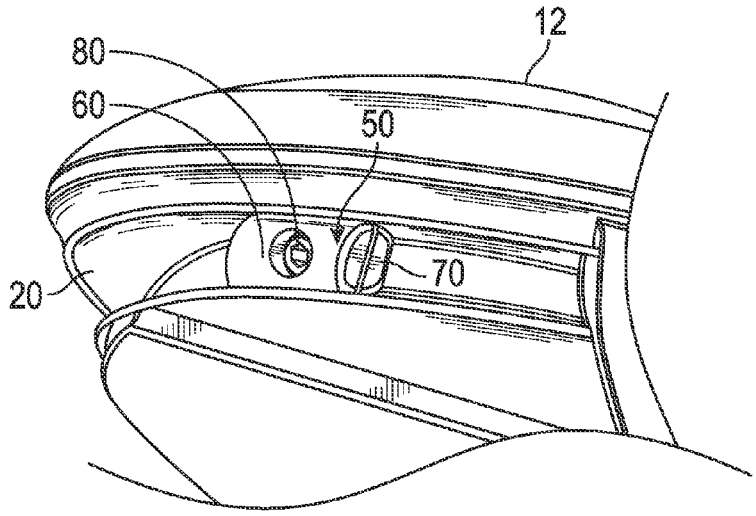
FIG. 9 is an enlarged view of the circled portion in FIG. 5, with the weight in a fixed configuration.
Figure 10:
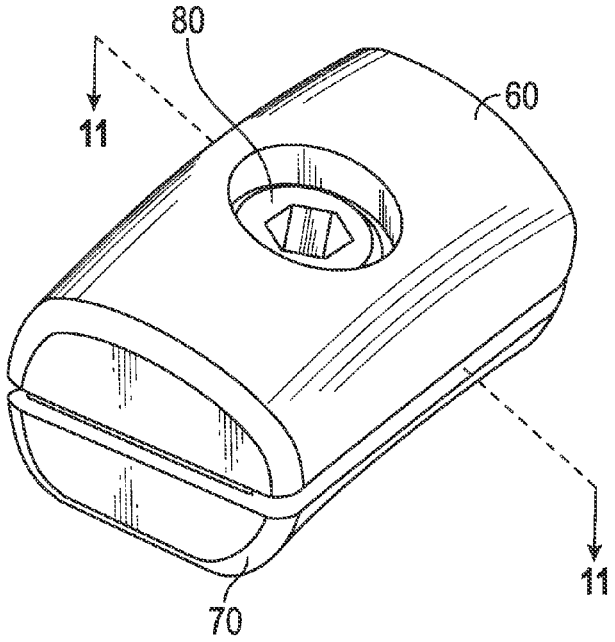
FIG. 10 is a side perspective view of the weight shown in FIG. 9.
Figure 11:
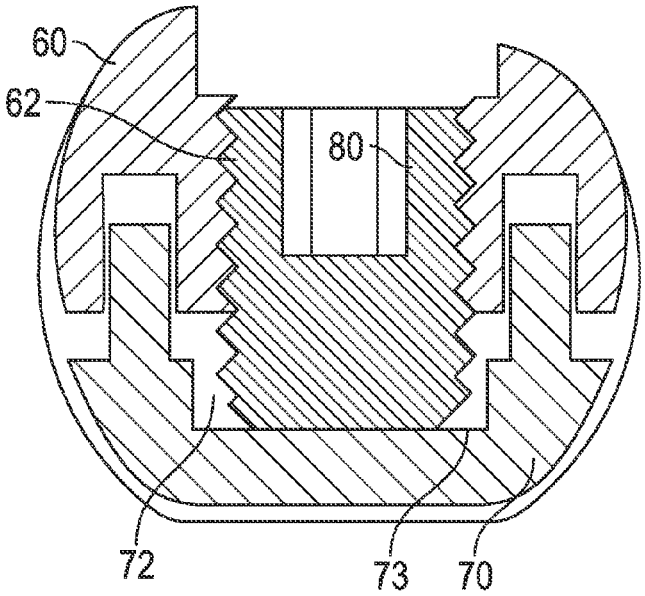
FIG. 11 is a cross-sectional view of the weight shown in FIG. 10 along lines 11-11.

While in the configuration shown in FIGS. 6-8, the dimensions of the slidable weight 50 are such that the slidable weight 50 fits loosely within the channel 20 and can be moved along the length of the channel 20, though the slidable weight 50 still has a width that is great enough to prevent it from falling out of the channel 20. When a golfer has moved the slidable weight 50 to a desired position within the channel 20, he or she can tighten the bolt 80, which causes the bolt 80 to move downward within the threaded bore 62, press against the floor 73 of the cavity 72 of the lower portion 70 of the weight, and push the upper portion 60 of the slidable weight 50 away from the lower portion 70, as shown in FIGS. 9-11. As it is pushed upwards, the upper portion 60 of the slidable weight 50 presses against the sides of the channel 20, effectively using friction to wedge the slidable weight 50 into a fixed position within the channel 20. In the embodiment shown in FIGS. 6-8, at least one, and preferably both, of the upper portion 60 and lower portion 70 of the slidable weight 50 is composed of a metal material, particularly stainless steel, that is co-molded with a polymeric material, and preferably rubber, to increase friction between the slidable weight 50 and the walls of the channel 20 and more securely fix the slidable weight 50 within the channel 20.

Because the opening of the channel 20 has a smaller width W2 than the width of the slidable weight 50, the slidable weight 50 does not fall out of the channel 20 when it is in its expanded configuration. In this way, the slidable weight 50 can be reversibly fixed at any location within the channel 20, not just at points within the channel 20 that have predetermined openings or notches as required in prior art clubs such as those disclosed in U.S. Pat. Nos. 7,611,424 and 8,016,694.

Figure 12:
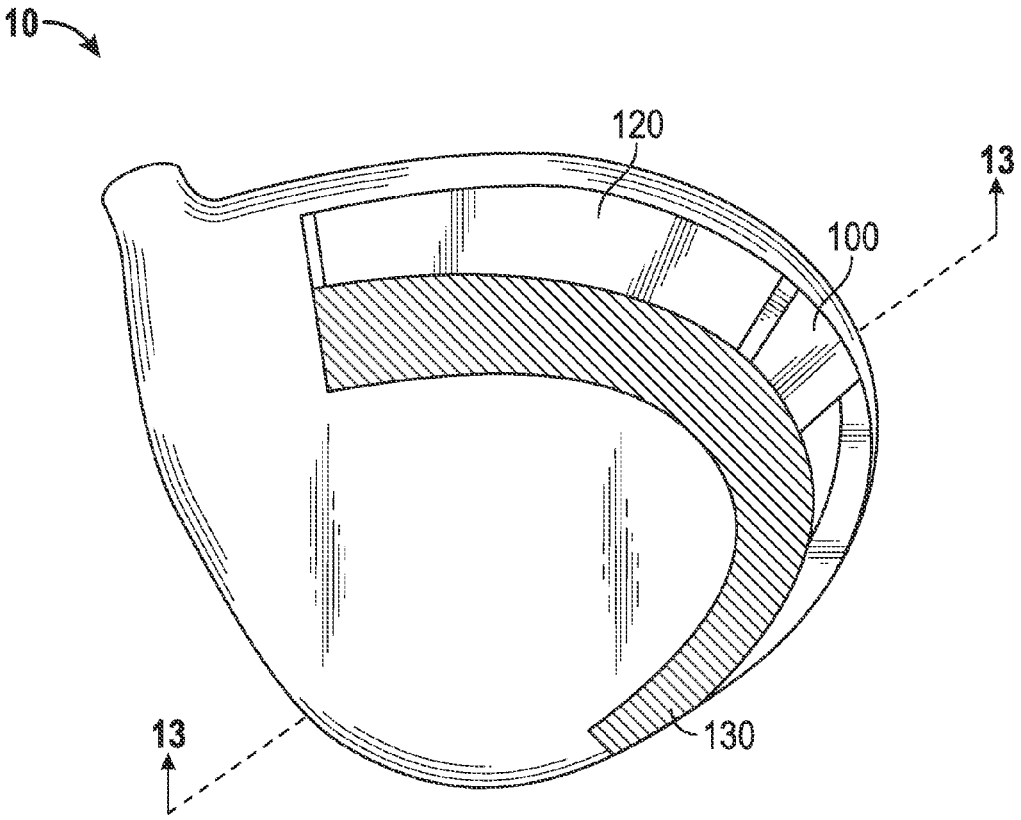
FIG. 12 is a bottom perspective view of a golf club head encompassing a third embodiment of the present invention.
Figure 13:
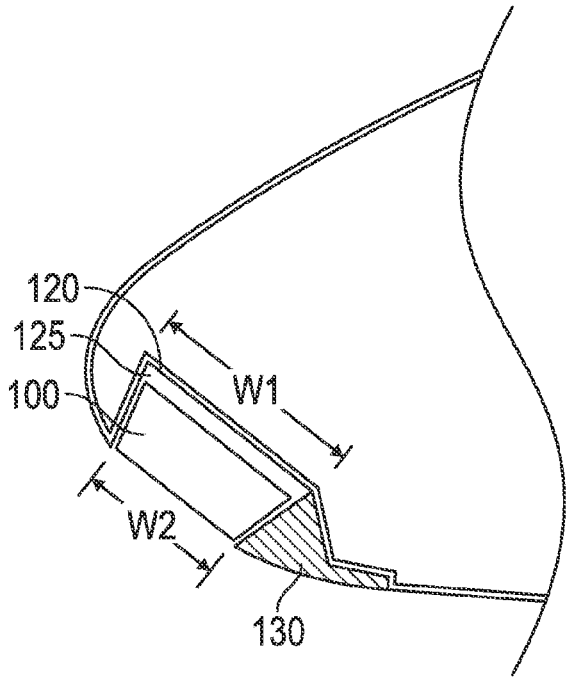
FIG. 13 is a cross-sectional view of the embodiment shown in FIG. 12 along lines 13-13.

A third embodiment of the present invention is shown in FIGS. 12 and 13. In this embodiment, the slidable weight 100 is trapezoidal, and the channel 120 is formed from a recessed part 125 of the sole 14 or ribbon 15 of the golf club head 10 and a cover fixture 130 that traps the slidable weight 100 within the channel 20. This embodiment may include a weight screw 40 or plug as disclosed in the first and second embodiments, but it is not necessary in order to trap the slidable weight 100 within the channel 120. In order to assemble this embodiment, the slidable weight 100 is placed within the recessed part 125 and the cover fixture 130 is permanently or removably affixed to the sole 14 or ribbon 15. The slidable weight 100 may be fixed at any location within the channel 120 using any of the means disclosed herein. As in the other embodiments disclosed herein, the slidable weight 100 has a width that is larger than the width W2 of the opening of the channel 120, preventing the slidable weight 100 from falling out of the channel 120 during use.

Figure 14:
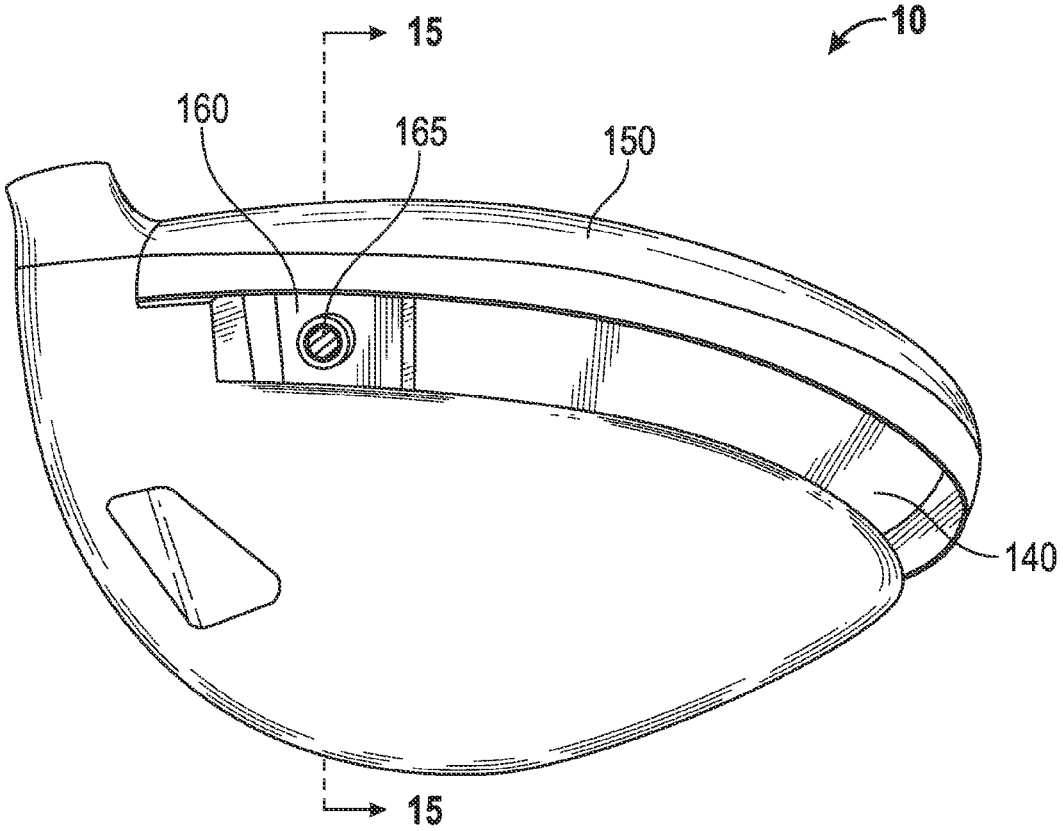
FIG. 14 is a side perspective view of a golf club head encompassing a fourth embodiment of the present invention.
Figure 15:
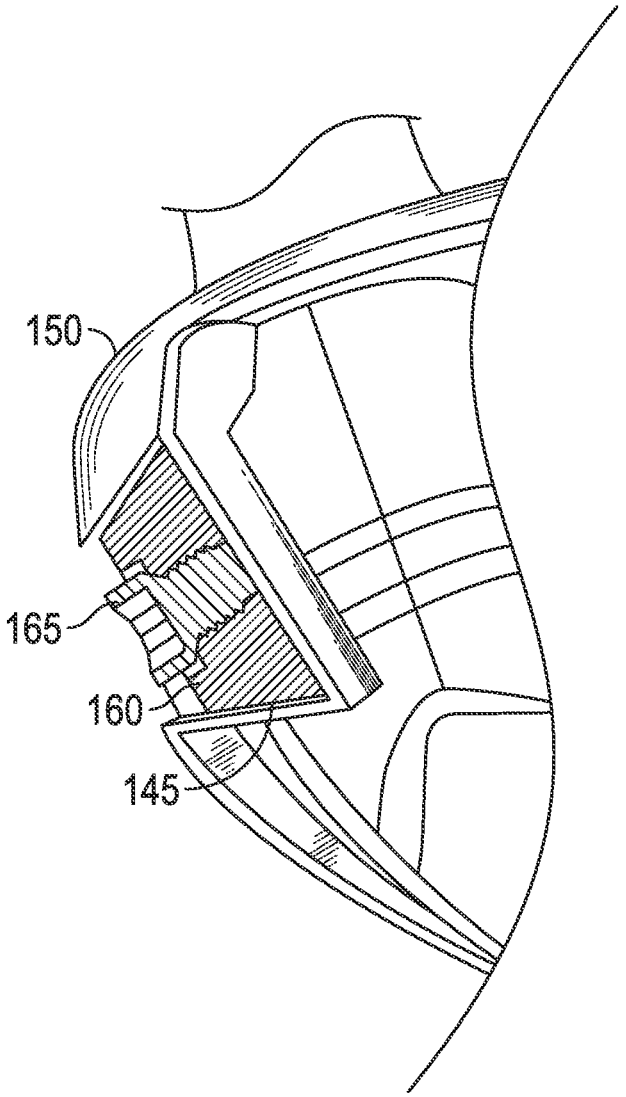
FIG. 15 is a cross-sectional view of the embodiment shown in FIG. 14 along lines 15-15.

A fourth embodiment of the present invention is shown in FIGS. 14 and 15. In this embodiment, the channel 140 is formed from a recessed portion 145 of the sole 14 or ribbon 15 of the golf club head 10 and a separate crown piece 150, which preferably is formed from a composite material, but may in other embodiments be formed from lightweight metal alloys such as magnesium and aluminum alloys, from plastic, or from titanium alloy or stainless steel. As in the third embodiment, the slidable weight 160 of this embodiment is trapezoidal and may be fixed within the channel 140 with a bolt 165 or by any other means disclosed herein. As in the third embodiment, this embodiment may be assembled by placing the slidable weight 160 within the recessed portion 145 and then permanently or removably affixing the crown piece 150 to the rest of the golf club head 10, trapping the slidable weight 160 within the channel 140.

Figure 16:
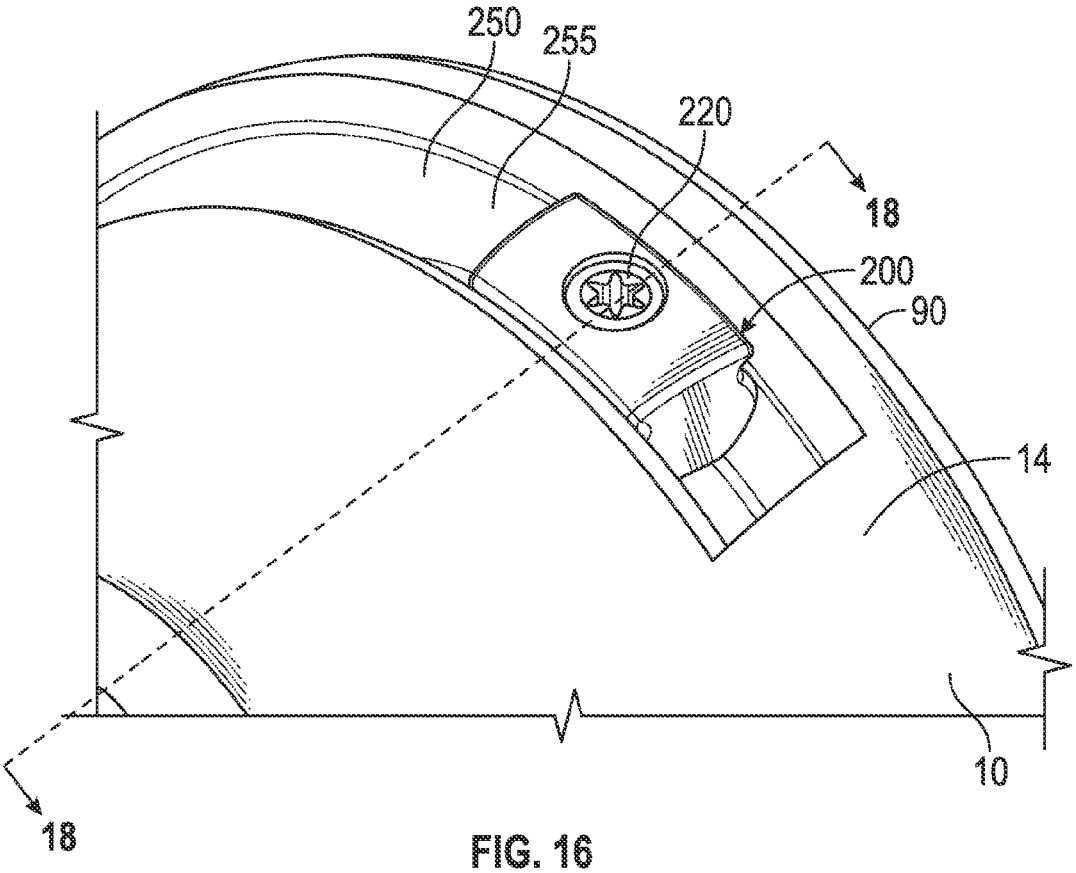
FIG. 16 is a sole perspective view of a portion of a golf club head encompassing a fifth embodiment of the present invention.
Figure 17:
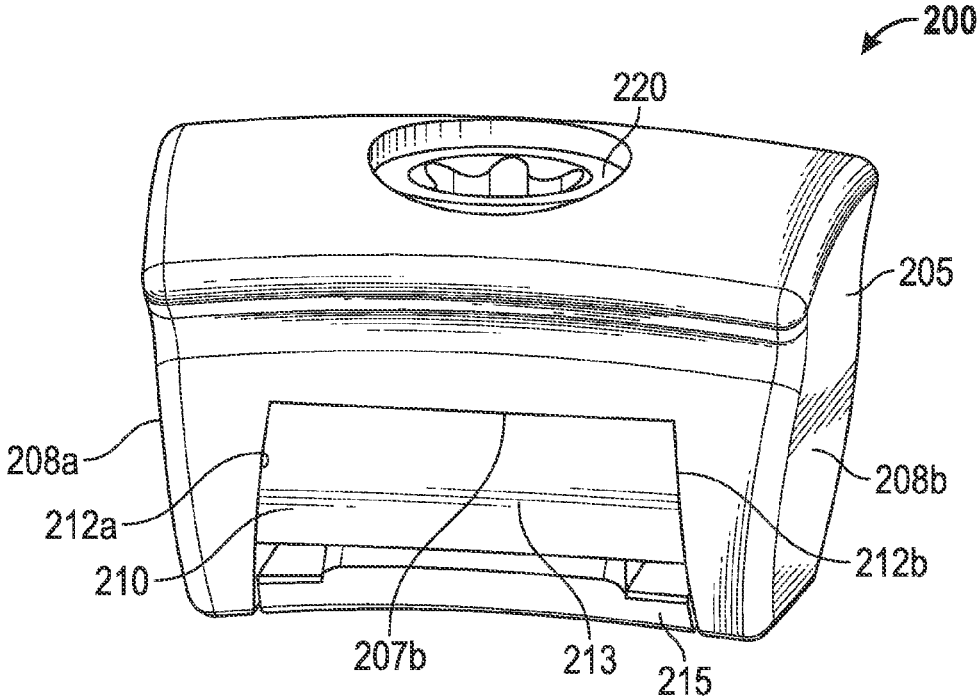
FIG. 17 is a side perspective view of the slidable weight shown in FIG. 16.
Figure 18:
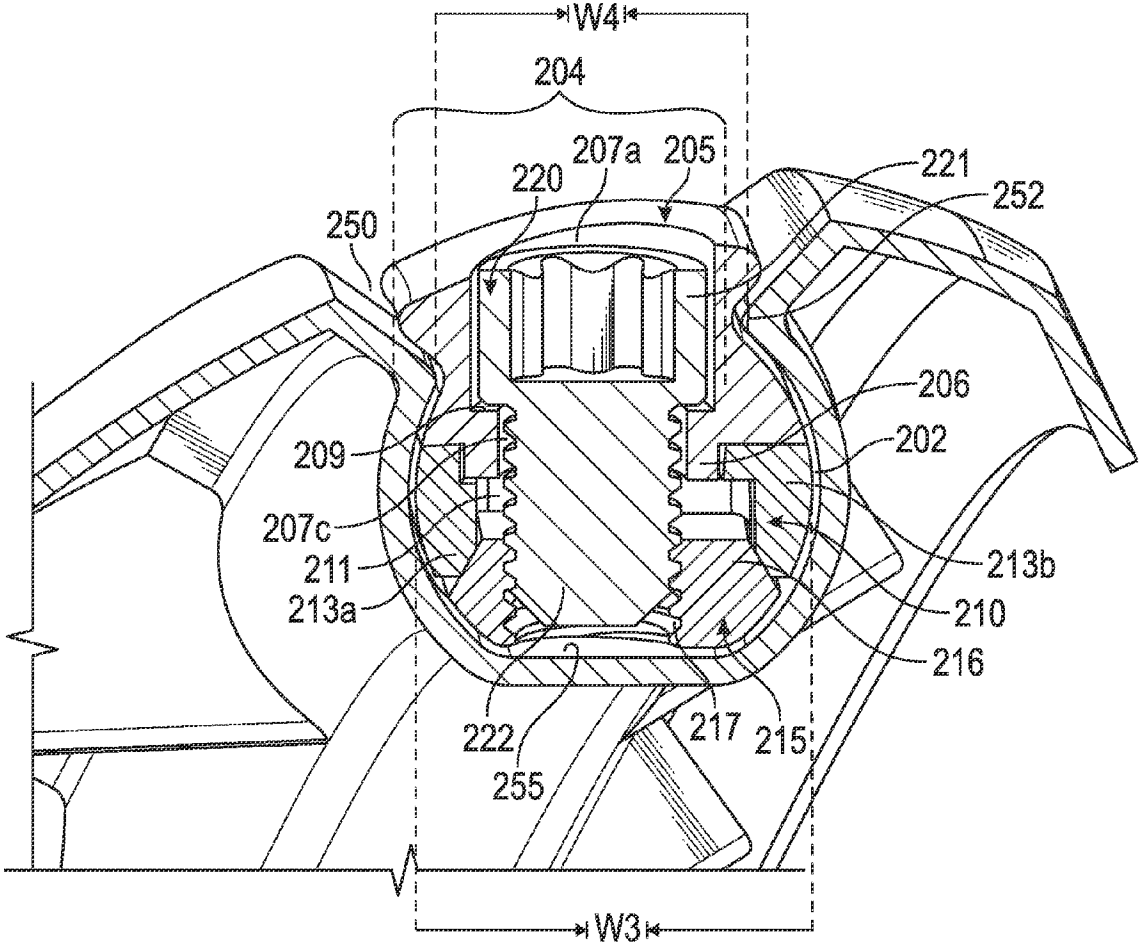
FIG. 18 is a cross-sectional view of the embodiment shown in FIG. 16 along lines 18-18.

A preferred embodiment of the present invention is shown in FIGS. 16-18. This embodiment is similar to the one shown in FIGS. 5-11, but includes a three-piece slidable weight 200 instead of a two-piece slidable weight 50, and the various pieces of the three-piece slidable weight 200 are obscured from view when the slidable weight 200 is disposed within the channel 250 of the golf club head 10. The three-piece slidable weight 200 of the preferred embodiment is also similar to the embodiment shown in FIGS. 4 and 15, in that the bolt 220 makes contact with the floor portion 255 of the channel 250 instead of a portion of the slidable weight 200 when the three-piece slidable weight 200 is fixed within the channel 250.

In the preferred embodiment, the slidable weight 200 includes an upper portion 205 composed of a durable metal material, preferably 17-4 stainless steel, a middle portion 210 composed of a lightweight, expandable material, preferably injection-molded plastic or rubber, and a lower portion 215 composed of a metal material, the composition of which can be adjusted depending on the weighting needs of the golf club head 10. Any of these portions 205, 210, 215, and particularly the upper and lower portions 205, 215, may be co-molded with a polymeric material as desired by the manufacturer. The upper portion 205 includes an upper recess **207*a* sized to receive the head 221 of the bolt 220, an unthreaded through bore 207*c* sized to receive the threaded portion 222 of the bolt 220, and a ledge 209 against which the head 221 of the bolt 220 rests. The lower portion 215 includes a through bore 217 with internal threads 218 that grip the threaded portion 222 of the bolt 220, prevent the bolt from disengaging from the slidable weight 200, and thus hold the portions 205, 210, 215 of the slidable weight 200** together.

As shown in FIG. 17, the upper portion 205 of the slidable weight 200 also includes a lower recess 207*b* sized to receive the middle portion 210, such that the middle portion 210 is flanked on two sides 212*a*, 212*b* by walls 208*a*, 208*b* of the upper portion 205. In this way, when the middle portion 210 is compressed, it is forced to expand outwards at its exposed sides 213*a*, 213*b* and press against the walls of the channel 250. The middle portion 210 further includes an unthreaded through bore 211 sized to receive the threaded portion 222 of the bolt 220, as well as a lower part 206 of the upper portion 205 and an upper part 216 of the lower portion 215. The through bore 211 allows the upper portion 205 and the lower portion 215 to at least partially nest within the middle portion 210 and further holds each of the three portions 205, 210, 215 together without requiring the use of adhesives or other bonding means, though in alternative embodiments one or more of the portions 205, 210, 215 may be bonded together.

The slidable weight 200 has an hourglass-like cross-sectional shape, as shown in FIG. 18, which fits within the hourglass-like cross-sectional shape of the channel 250. This shape exposes a greater surface area 204 of the slidable weight 200 to a user without allowing the slidable weight 200 to fall out of the channel 250 during use. The channel 250 includes a narrow region 252 that retains the slidable weight 200 within the channel 250, as the widest region 202 of the slidable weight 200 has a width W3 that is greater than the width W4 of the narrow region 252 of the channel 250. In this way, the slidable weight 200 is effectively trapped within the channel 250.

When a user wishes to adjust the location of the slidable weight 200 shown in FIGS. 16-18, the user loosens the bolt 220 so that it does not make contact with the floor portion 255 of the channel 250 and then moves the slidable weight 200 to a desired location within the channel 250 which, in the preferred embodiment, is located in the sole 14 at a rear end 90 of the golf club head 10. The user then tightens the bolt 220 so that the threaded portion 222 moves downwards through the threaded bore 217 of the lower portion 215, compressing the middle portion 210 between the upper and lower portions 205, 215, which may cause the middle portion 210 to expand at its exposed sides 213*a*, 213*b* and make contact with the walls of the channel 250. At the same time, as the threaded portion 222 of the bolt 220 extends through the threaded bore 217 and makes contact with and presses against the floor portion 255 of the channel 250, it pushes the lower portion 215, and thus the middle and upper portions 210, 205 upwards, causing the widest region 202 of the slidable weight 200 to press against the narrow region 252 of the channel 250. In this way, the bolt 220 removably fixes the slidable weight 200 at any point within the channel.

In a further embodiment, the golf club head 10 and slidable weight 200 embodiment shown in FIGS. 16-18 may also include the opening 25 and weight screw 40 combination shown in FIGS. 1-6.

Figure 19:
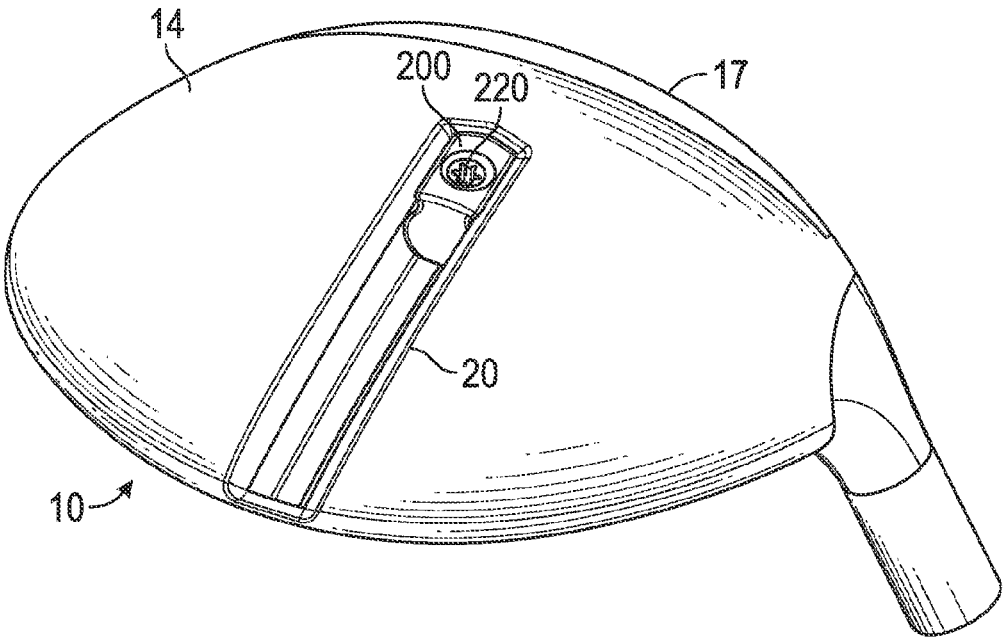
FIG. 19 is a sole perspective view of a golf club head according to a sixth embodiment of the present invention.
Figure 20:
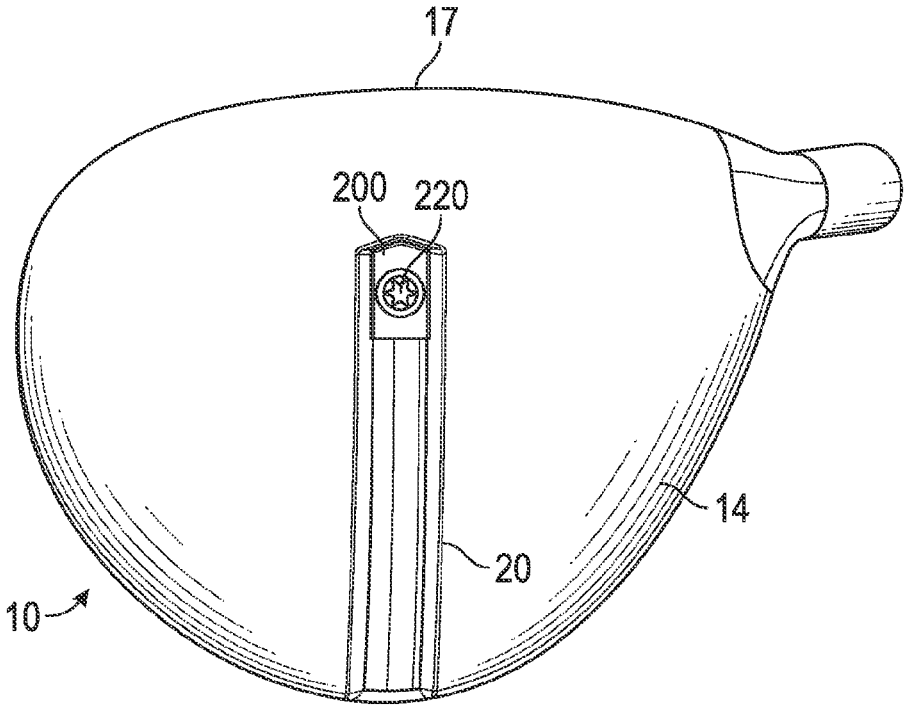
FIG. 20 is a sole plan view of the golf club head shown in FIG. 19.

In alternative embodiments, the channels 20, 120, 140, 250 of the present invention may be disposed in the sole 14 perpendicular to the face 17, as shown in FIGS. 19-20, or on the crown 12. Though the embodiment shown in FIGS. 19-20 is shown with the three-piece slidable weight 200, it may use any of the slidable weight embodiments disclosed herein. In other embodiments, the channel 20 may extend from the sole 14 to the crown 12 or be disposed entirely on the crown 12. In each of the embodiments disclosed herein, the face 17 and sole 14 of the golf club head 10 preferably are formed from a metal material, while the crown 12 is formed from a non-metal material such as composite. In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a channel;

an expandable weight disposed, and movable to any point, within the channel; and a cover fixture, wherein affixing the cover fixture to the body traps the expandable weight within the channel, wherein the expandable weight comprises an upper portion composed of a metal material, a middle portion composed of a polymeric material, a lower portion composed of a metal material, and a bolt, and wherein expanding the weight reversibly fixes it in place within the channel.

2. The golf club head of claim 1, wherein the body comprises a sole, wherein the channel is disposed in the sole, and wherein the cover fixture is a crown.

3. The golf club head of claim 2, wherein the crown is composed of a material selected from the group consisting of composite, plastic, titanium alloy, and stainless steel.

4. The golf club head of claim 1, wherein the upper portion is composed of a first metal material, and wherein the lower portion is composed of a second metal material that is different from the first metal material.

5. The golf club head of claim 4, wherein the first metal material is 17-4 stainless steel and wherein the polymeric material is injection molded plastic.

6. The golf club head of claim 5, wherein the polymeric material is selected from the group consisting of plastic and rubber.

7. The golf club head of claim 5, wherein the lower portion is composed of a tungsten alloy.

8. The golf club head of claim 1, wherein the body comprises a face, a sole, a crown, a heel end, a toe end, and a rear end, and wherein the channel is disposed within the sole proximate the rear end.

9. The golf club head of claim 8, wherein the channel extends from the toe end to the heel end.

10. The golf club head of claim 1, wherein the upper portion comprises a first through bore, an upper recess, a lower recess, and a ledge, wherein the bolt comprises a head and a threaded portion, wherein the threaded portion extends through the through bore, and wherein the head is disposed within the upper recess and rests against the ledge.

11. The golf club head of claim 10, wherein the middle portion comprises a second through bore sized to receive the threaded portion, and wherein the middle portion is disposed within the lower recess.

12. The golf club head of claim 11, wherein the lower portion comprises a third through bore sized to receive the threaded portion, wherein the lower portion is disposed below the middle portion so that the middle portion is sandwiched between the upper portion and the lower portion, and wherein the third through bore comprises threads sized to mate with the threads of the threaded portion.

13. The golf club head of claim 12, wherein the golf club head is selected from the group consisting of a driver head, a fairway wood head, and a hybrid head.

14. The golf club head of claim 1, wherein the cover fixture is removably affixed to the sole.

15. A driver-type golf club head comprising:

a composite crown;

a metal body comprising a face, a sole, and a channel;

an expandable weight comprising:

a metal upper portion comprising a first through bore, an upper recess, a lower recess, and a ledge;

a polymeric middle portion comprising a second through bore;

a metal lower portion comprising a third through bore; and a bolt comprising a head and a threaded portion; and a cover fixture removably affixed to the sole to retain the expandable weight within the channel, wherein expanding the weight reversibly fixes it in place at any of a plurality of locations within the channel.

16. The driver-type golf club head of claim 15, wherein the threaded portion of the bolt extends through the first and second through bores, and wherein the head of the bolt is disposed within the upper recess and rests against the ledge.

17. The golf club head of claim 16, wherein the middle portion is disposed within the lower recess of the upper portion.

18. The golf club head of claim 16, wherein the middle portion is sandwiched between the upper portion and the lower portion, and wherein the third through bore comprises threads sized to mate with the threads of the threaded portion.

* * * * *